US005265385A

United States Patent [19]

Smith et al.

[11] Patent Number: 5,265,385

[45] Date of Patent: Nov. 30, 1993

[54] SMALL VEHICLE STORAGE APPARATUS

[76] Inventors: Andrew M. Smith, 2217 N. 79th St., Scottsdale, Ariz. 85257; Steve T. Stewart, 6505 E. Osborne #179, Scottsdale, Ariz. 85251

[21] Appl. No.: 737,988

[22] Filed: Jul. 30, 1991

[51] Int. Cl.[5] ..... E04H 6/04; E04H 6/42

[52] U.S. Cl. ..... 52/79.5; 52/69; 52/143; 52/264; 52/271

[58] Field of Search ..... 52/143, 174, 64, 66, 52/69, 79.5, 741, DIG. 14, 271, 285, 584, 264; 135/88

[56] References Cited

U.S. PATENT DOCUMENTS

| | | | |
|---|---|---|---|
| 2,282,324 | 5/1942 | Exeritt | 52/174 |
| 2,803,856 | 8/1957 | Kofahl et al. | 52/584 X |
| 3,023,463 | 3/1962 | Bigelow | 52/143 X |
| 3,667,172 | 6/1972 | Erickson | 52/143 X |
| 3,945,159 | 3/1976 | Girnus | 52/66 |
| 3,949,528 | 4/1976 | Hartger et al. | 52/174 X |
| 4,035,965 | 7/1977 | Ronai | 52/143 X |
| 4,074,475 | 2/1978 | Wahlquist | 52/143 X |
| 4,166,343 | 9/1979 | O'Brian et al. | 52/69 X |
| 4,272,930 | 6/1981 | Foster | 52/27 X |
| 4,306,390 | 12/1981 | Brown | 52/66 X |
| 4,438,063 | 3/1984 | Chardon et al. | 52/79.1 |
| 4,587,788 | 5/1986 | Bielicki | 52/285 X |
| 4,986,037 | 1/1991 | Jackson | 52/64 X |

FOREIGN PATENT DOCUMENTS

| | | | |
|---|---|---|---|
| 0185078 | 9/1936 | Fed. Rep. of Germany | 52/DIG. 14 |
| 0815100 | 8/1951 | Fed. Rep. of Germany | 52/DIG. 14 |
| 2078680 | 1/1982 | United Kingdom | 52/64 |

*Primary Examiner*—Carl D. Friedman
*Assistant Examiner*—Robert Canfield
*Attorney, Agent, or Firm*—Harry M. Weiss

[57] ABSTRACT

A storage apparatus for a small vehicle is disclosed. This apparatus is constructed with modular panels which can be assembled together by hand without any tools. The modular panels are of substantially flat construction which can be stacked and stored in a relatively small space when the apparatus is disassembled and not in use. The apparatus includes tanks of water to provide additional weight to the apparatus to inhibit easily moving the apparatus with its stored vehicle. These tanks of water may be filled prior to the vehicle being loaded into the apparatus, or may be filled after the vehicle is in place. The tanks are removable from the apparatus with the vehicle in place, allowing easy movement of the apparatus by simply removing the tanks, without removing the vehicle.

14 Claims, 3 Drawing Sheets

SMALL VEHICLE STORAGE APPARATUS

FIELD OF THE INVENTION

This invention relates generally to storage apparatus and methods, and, more specifically, to a storage apparatus and method for a small vehicle such as a motorcycle, bicycle, snowmobile, jet ski, all-terrain vehicle (ATV) and the like to protect the stored vehicle from theft, vandalism, and the elements.

DESCRIPTION OF THE PRIOR ART

In the past an owner of a motorcycle, bicycle, snowmobile, jet ski, ATV or like vehicle either stored the vehicle in a garage or shed or chose to leave the vehicle outside, susceptible to theft, vandalism, and the deteriorating weathering effects of the elements. Many would-be owners of these types of small vehicles choose not to enjoy the benefits of ownership simply because they do not have storage space for the vehicle they wish to purchase, and are hesitant to leave the vehicle outside. As a specific example, those who live in apartments or condominiums typically do not have access to a garage or storage space large enough to conveniently accommodate these types of vehicles, and must store these vehicles somewhere outside, where theft or vandalism might occur. Therefore, a need existed to provide a storage apparatus that would completely enclose the vehicle, protecting it from vandalism and the elements, and that has a means for deterring theft of the entire storage apparatus with its enclosed stored vehicle.

One such apparatus is disclosed in U.S. Pat. No. 4,438,606. This apparatus provides a box with a lower compartment, wherein ballast is placed to make the apparatus too heavy to easily move by would-be thieves. The construction of the box is such that the apparatus is put in its desired location; the ballast compartment is filled with ballast consisting of gravel, earth, or blocks; the floor of the box is placed on top of the ballast compartment; and the vehicle is then put on top of the floor of the box. This type of storage apparatus has the disadvantage that the vehicle to be stored must be placed into the apparatus after the ballast is in place. In order to move the apparatus to a different location the vehicle must be removed, the floor must be removed, and the ballast must be removed. At this point the apparatus can be moved to another location. Another problem with the prior art storage apparatus is the space the apparatus takes when not in use.

Therefore a need existed to provide a modular storage apparatus that can be easily and quickly assembled and, if desired, disassembled to be stored in very little space when not in use, that can be assembled using no tools, and that contains a ballast that can be removed from the apparatus without removing the vehicle thereby allowing for easily moving the location of the apparatus with its stored vehicle when desired.

SUMMARY OF THE INVENTION

It is an object of this invention to provide an improved storage apparatus and method for enclosing and protecting a small vehicle such as a motorcycle, bicycle, snowmobile, jet ski, ATV and the like.

It is another object of this invention to provide a storage apparatus and method for enclosing and protecting a small vehicle wherein the apparatus includes a removable ballast at the bottom thereof to prevent easily moving the apparatus when the ballast is in place at the bottom of the apparatus and to permit easily moving the apparatus with its enclosed vehicle when the ballast is removed.

It is a further object of this invention to provide a storage apparatus and method for enclosing and protecting a small vehicle wherein the apparatus includes a ballast that is easily removable while a vehicle is in the apparatus.

It is another object of this invention to provide a storage apparatus and method for enclosing and protecting a small vehicle wherein the apparatus is modular in construction allowing the apparatus to occupy a relatively small space when disassembled and not in use.

It is still another object of this invention to provide a modular storage apparatus for enclosing and protecting a small vehicle that can be assembled using no tools.

According to the preferred embodiment of the present invention, a storage apparatus for enclosing and protecting a small vehicle is provided. This apparatus is of modular construction consisting of a bottom panel, a rear panel, two side panels, a front panel, and a top panel. These panels are constructed so that they can be assembled together without tools. Each panel is substantially flat, allowing the panels to be stacked and stored in a very small area when the storage apparatus is not in use. The bottom panel of the apparatus includes a compartment for placing ballast therein to make the apparatus too heavy to easily move. This ballast preferably consists of water in round polyvinyl chloride (PVC) pipes. These pipes can be quickly removed from the compartment by simply removing the top panel and the rear panel. In this manner the ballast can be removed and the apparatus moved to a different location without removing the vehicle from within the apparatus. The ballast can then be replaced in the apparatus in its new location.

DESCRIPTION OF THE PREFERRED EMBODIMENT

Figure 1:
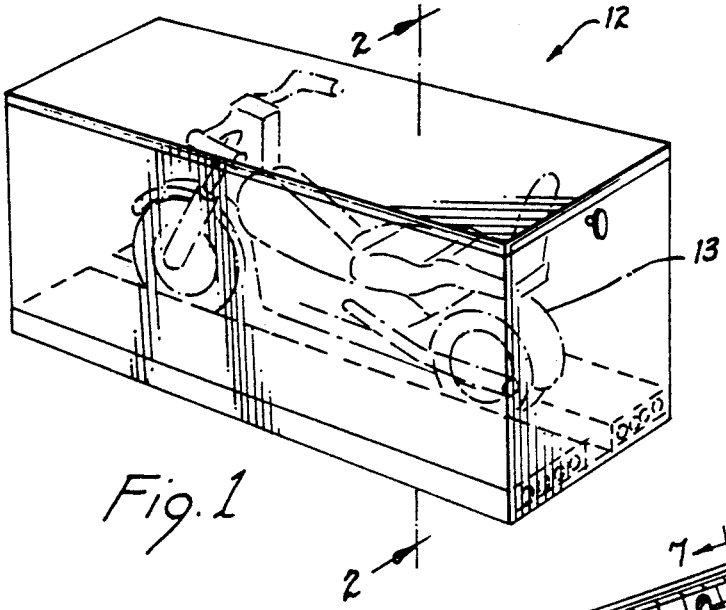
FIG. 1 is a perspective view of the small vehicle storage apparatus according to the present invention.
Figure 4:
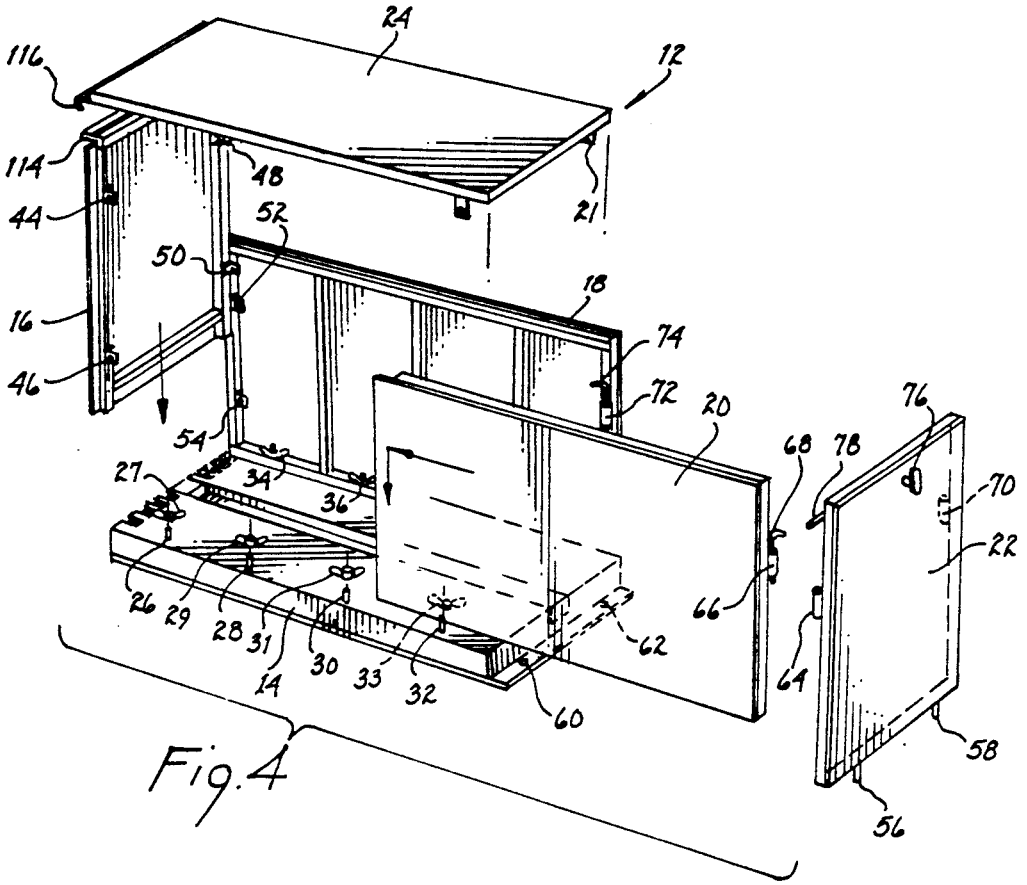
FIG. 4 is a perspective view of the small vehicle storage apparatus of FIG. 1 showing each of the modular panels.

In accordance with the preferred embodiment of the present invention, a small vehicle storage apparatus 12 is shown in FIG. 1 with its associated vehicle 13. A motorcycle is shown as the vehicle 13 as one specific example of the many different vehicles that could be stored in the storage apparatus 12. As shown in FIG. 4, this storage apparatus is comprised of six modular panels: bottom panel assembly 14, rear panel 16, right side panel 18, left side panel 20, front panel 22, and top panel 24.

Figure 5:
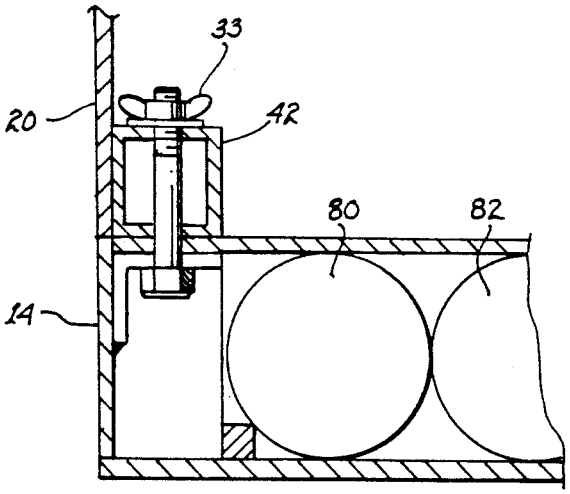
FIG. 5 is a detailed view of the attachment between side panel and bottom panel shown in FIG. 3.

Bottom panel 14 has screw posts 26, 28, 30, and 32 fixedly mounted thereto and extending upwards. Left side panel 20 has a bottom member 42 as shown in FIG. 5 with holes that correspond to the spacing of the screw posts 26, 28, 30 and 32. Left side panel 20 is attached to the bottom panel 14 by lifting the side panel 20 above the screw posts such that the corresponding holes in member 42 of left side panel 20 line up with the screw posts. The left side panel 20 is then lowered such that the screw posts pass through the corresponding holes in the bottom member 42. Left side panel 20 is then secured into place using wing nuts 27, 29, 31 and 33 as shown in FIG. 4, which can be secured by hand without the use of tools.

Bottom panel 14 also has screw posts in a similar configuration on the right side that pass through corresponding holes in the bottom member of right side panel 18. Right side panel 18 is secured to bottom panel 14 using wing nuts 34, 36, 38, and 40 (FIG. 2) in a similar manner to left side panel 20.

Figure 6:
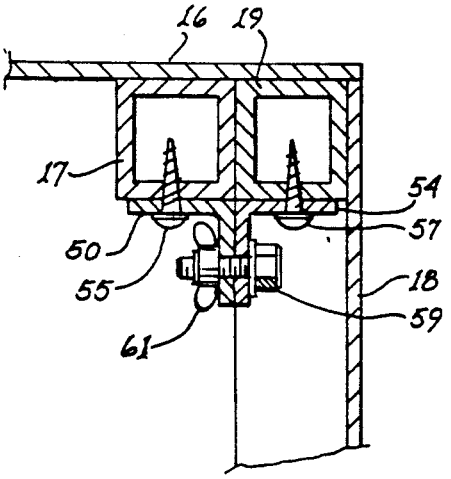
FIG. 6 is a partial cross sectional view of the attachment between side panel and rear panel in FIG. 2 taken along the line 6—6.

As shown in FIG. 4, rear panel 16 has angle brackets 44 and 46 which are used to secure rear panel 16 to left side panel 20, and angle brackets 48 and 50 which are used to secure rear panel 16 to right side panel 18. Right side panel 18 has angle brackets 52 and 54 that correspond to respective angle brackets 48 and 50 on rear panel 16. Referring to FIG. 6, angle bracket 54 is fixedly attached to a member 19 of right side panel 18 using a screw 57. Angle bracket 50 is fixedly attached to a member 17 of rear panel 16 using a screw 55. Angle bracket 50 has a hole that lines up coincident to a corresponding hole in angle bracket 54 when the rear panel 16 and right side panel 18 are properly in place. A screw 59 is passed through the hole in angle brackets 52 and 48 as shown, and is secured with a wing nut 61 by hand without the use of tools. This procedure is followed for each of the four angle bracket pairs to secure left side panel 20 and right side panel 18 to rear panel 16.

Figure 2:
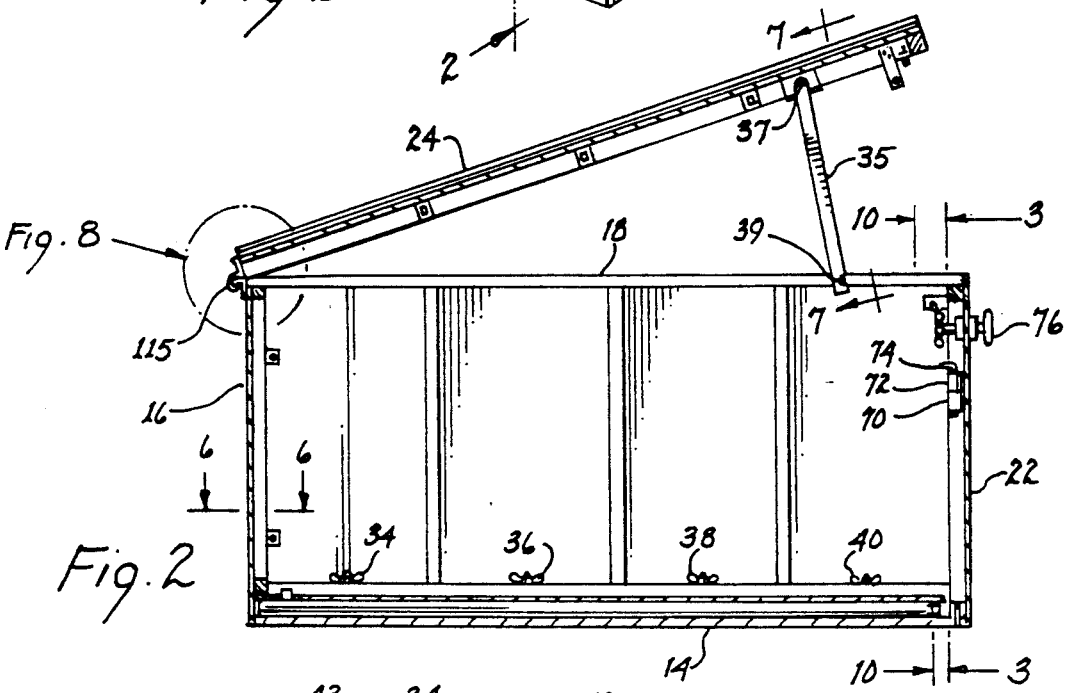
FIG. 2 is a cross sectional view of the small vehicle storage apparatus of FIG. 1 taken along the line 2—2.

Referring again to FIG. 4, front panel 22 has two positioning pins 56 and 58 which slide into corresponding holes 60 and 62 in the bottom panel 14 when the front panel 22 is properly in place. Front panel 22 is secured to left side panel 20 by lining up pin receptor 64 on the front panel 22 to be coincident with pin receptor 66 on the left side panel 20 and inserting the pin 68 through both pin receptors 66 and 64. Front panel 22 is secured to right side panel 18 by lining up pin receptor 70 on the front panel 22 to be coincident with pin receptor 72 on the right side panel 18 and inserting the pin 74 through both pin receptors 72 and 70. A view of pin 74 properly installed in pin receptors 72 and 70 is shown in FIG. 2.

Figure 8A:
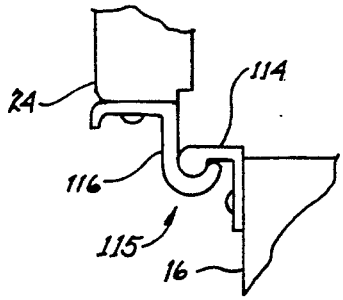
FIG. 8A is a detailed elevational view of the hinge shown in FIG. 8 with the top panel in a position to allow removal of the top panel from the rear panel.
Figure 8:
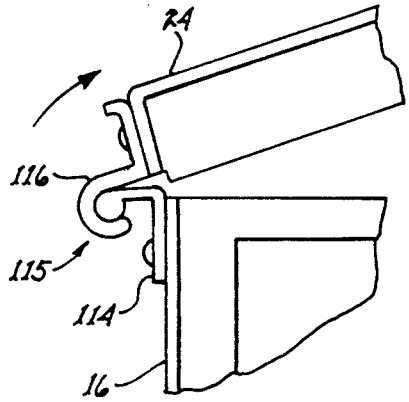
FIG. 8 is a detailed elevational view of the hinge between the top panel and the rear panel shown in FIG. 2.

As shown in FIGS. 8 and 8A, top panel 24 is movably mounted to rear panel 16 by way of a two-piece hinge 115. This hinge 115 is constructed such that the two pieces 114 and 116 can only be separated by sliding piece 116 longitudinally with respect to piece 114 when the two pieces are in the position shown in FIG. 8A. In this manner the top panel 24 may be separated from the rear panel 16 when the top panel 24 is in a plane parallel to rear panel 16 as shown in FIG. 8A. When top panel 24 is pivoted to a position shown in FIG. 8 that is not in a parallel plane with respect to the rear panel 16, the two pieces 114 and 116 of hinge 115 are engaged to prohibit longitudinal movement of one piece with respect to the other piece. Therefore, installation of the top panel is accomplished by placing top panel 24 in the position shown in FIG. 8A with respect to rear panel 16, and sliding the two pieces 114 and 116 of hinge 115 together as shown. Once the two pieces are properly in place, the top panel 24 can be pivoted about the hinge as shown in FIG. 8 to close the storage apparatus as needed.

Figure 3:
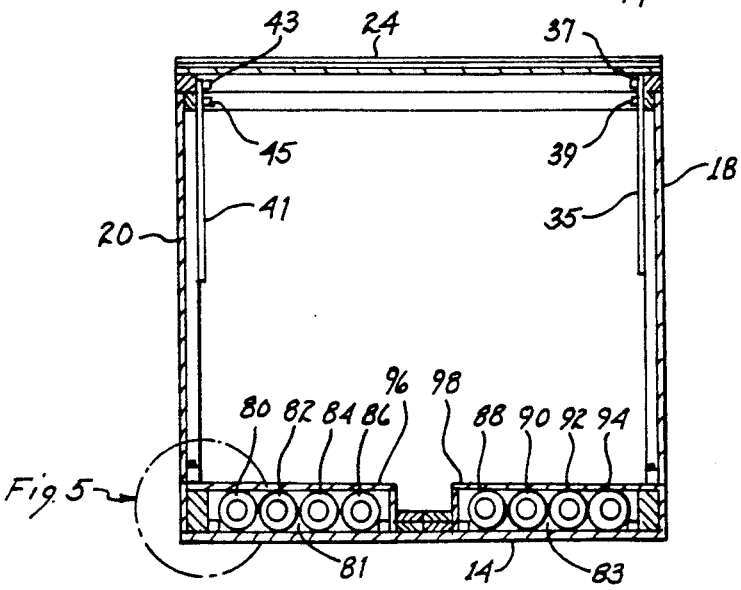
FIG. 3 is a cross sectional view of the small vehicle storage apparatus of FIG. 2 taken along the line 3—3.
Figure 7:
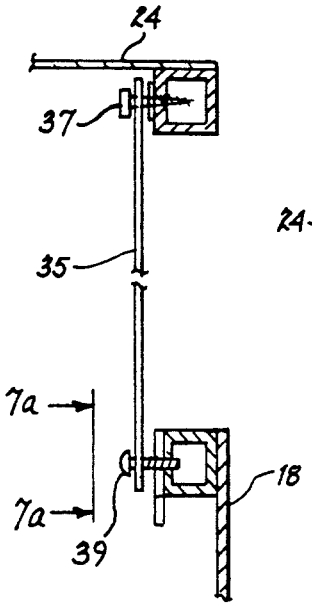
FIG. 7 is a partial cross sectional view of the top panel retainer arm shown in FIG. 2 along the line 7—7 with its associated connections.
Figure 7A:
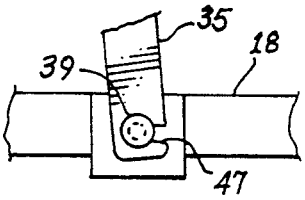
FIG. 7A is a side view of the connection between side panel and retainer arm shown in FIG. 7 along the line 7A—7A.

Top panel 24 includes retaining arms 35 and 41 shown in FIG. 3 for holding the top panel 24 in a partially open position, allowing for easier loading of the vehicle 13 in the apparatus 12. As shown in FIG. 7 retaining arm 35 is movably attached to top panel 24 using a screw 37. This attachment allows retaining arm 35 to pivot freely about the screw 37. Retaining arm 35 has a slot 47 shown in FIG. 7A which is used to position retaining arm 35 on retaining pin 39. Retaining pin 39 is fixedly attached to side panel 18 as shown in FIG. 7. The weight of the top panel 24 pushes the retaining arm 35 onto the retaining pin 39, retaining the top panel 24 in a partially opened position. Retaining arm 41 is movably attached to top panel 24 using screw 43, and has a corresponding retaining pin 45 fixedly attached to left side panel 20 (FIG. 3). In this manner, both sides of the top panel may be held in the partially opened position shown in FIG. 2 using retaining arms 35 and 41.

Figure 10:
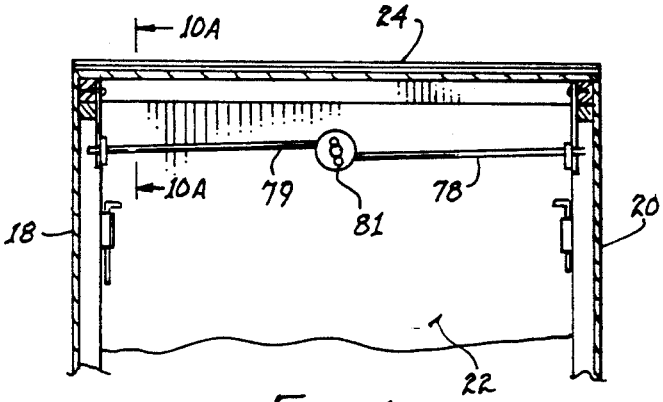
FIG. 10 is a cross sectional view of the front panel shown in FIG. 2 along the line 10—10.
Figure 10A:
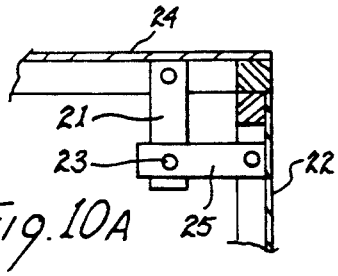
FIG. 10A is a partial cross sectional view of the connection between the top panel and the front panel shown in FIG. 10 along the line 10A—10A.

Front panel 22 includes means for locking the apparatus. The locking means comprises a handle 76 with key slot (FIG. 4) which rotates cam 81 (FIG. 10), thereby producing linear movement of lock rods 78 and 79. As shown in FIG. 10A, closing the top panel 24 causes a hole in locking bracket 21 attached to top panel 24 to line up coincident with a hole in locking bracket 25 attached to front panel 22. These coincident holes are shown as 23 in FIG. 10A. Turning the locking handle 76 causes cam 81 to turn, which causes lock rods 78 and 79 to extend outward towards the side panels 20 and 18. This outward extension action pushes lock rod 79 through coincident holes 23 of locking brackets 21 and 25, and likewise pushes lock rod 78 through coincident holes in corresponding locking brackets on the opposite side, thereby locking the top panel 24 to the front panel 22.

Figure 9:
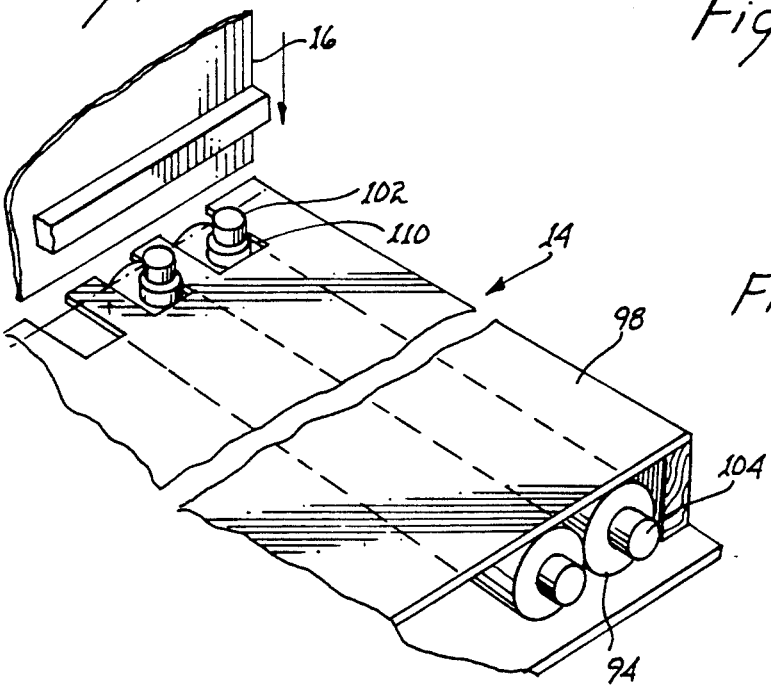
FIG. 9 is a partial perspective view of the bottom panel shown in FIG. 4 showing the placement of the water ballast tanks.

As shown in FIG. 3, bottom panel 14 includes compartments 81 and 83 for placing ballast. The ballast is in the form of a liquid, preferably water, contained in several tanks 80, 82, 84, 86, 88, 90, 92, and 94. These tanks are shown in more detail in FIG. 9. Tank 94 has a filler fitting 102 and a drain fitting 104, and is constructed of PVC pipe. The bottom panel 14 has a right platform 98 which covers tanks 88, 90, 92, 94, and a left platform 96 which covers tanks 80, 82, 84, and 86. The stored vehicle rests on platforms 98 and 96 Platform 98 has a slot 110 which allows the filler fitting 102 to be accessible after the apparatus 12 is assembled. Each tank 80, 82, 84, 86, 88, 90, and 92 is similar in construction and configuration to tank 94 as described above and shown in FIG. 9. These tanks may be filled or drained when installed in bottom panel 14 as shown in FIG. 9, or may be individually removed from bottom panel 14 for filling or draining as required. Removal of these tanks from the bottom panel 14 requires that rear panel 16 be removed. Each of these tanks may then be individually removed by sliding the tank towards the rear of the apparatus. In this manner the ballast may be removed from bottom panel 14 without removing the vehicle 13 from the apparatus 12, allowing for conveniently moving the location of the apparatus 12 with stored vehicle 13 as required. Note that if the apparatus 12 is locked, removal of rear panel 16 is impossible, assuring the ballast cannot be removed by an unauthorized person.

If the apparatus is not needed for a period of time, the modular panels 14, 16, 18, 20, 22, and 24 may be stacked flat and stored in a relatively small space.

The materials used in the construction of the apparatus illustrated in the drawings are aluminum tubing, aluminum sheet metal, and wood. Other materials such as steel, stainless steel, or plastic may be substituted and different manufacturing and attachment techniques may be employed within the scope of the claimed invention.

While the invention has been described in its preferred embodiments, it is to be understood that the words which have been used are words of description rather than limitation, and that changes may be made within the purview of the appended claims without departing from the true scope and spirit of the invention in its broader aspects.

I claim:

1. A storage apparatus for small vehicles comprising, in combination:

a rear panel;

a right side panel having a plurality of holes along a bottom edge thereof coupled to said rear panel;

a left side panel having a plurality of holes along a bottom edge thereof coupled to said rear panel;

a front panel coupled to both said right side panel and said left side panel;

a top panel coupled to at least one of said rear panel, said right side panel, said left side panel, and said front panel;

a bottom panel assembly having a first and second plurality of fixedly mounted posts extending upwardly therefrom coupled to said rear panel, said right side panel, said left side panel and said front panel, said right side panel having said plurality of holes along a bottom edge thereof corresponding to one of the first and second plurality of fixedly mounted posts extending upwardly from said bottom panel assembly, said left side panel having said plurality of holes along a bottom edge thereof corresponding to the other of the first and second plurality of fixedly mounted posts extending upwardly from said bottom panel assembly and comprising at least one upper platform and at least one lower platform separated by at least two side members to define at least one compartment within said bottom panel assembly;

each of said panels and said bottom panel assembly having attachment means for allowing assembly of said apparatus by hand without the use of tools; and ballast means for placement in said compartment of said bottom panel assembly to substantially increase the weight of said apparatus to prevent easily moving said apparatus, said ballast means comprising a plurality of completely enclosed liquid holding tanks extending along substantially the entire length of said bottom panel assembly.

2. The apparatus of claim 1 wherein said rear panel is pivotally coupled with a hinge to said top panel in such a manner to allow the top panel to pivot about the hinge with respect to the rear panel.

3. The apparatus of claim 2 wherein said hinge is comprised of two separate pieces which can be coupled together when said pieces are in one specific position, and which are engaged to prohibit separation of said two pieces when said pieces are in any position different from said specific position.

4. The apparatus of claim 1 wherein each of said tanks includes means for filling each of said tanks and means for drawing each of said tanks.

5. The apparatus of claim 4 wherein said means for filling each of said tanks and said means for draining each of said tanks comprise a single fitting on each of said tanks.

6. The apparatus of claim 4 wherein said means for filling each of said tanks comprises one fitting on each of said tanks and said means for draining each of said tanks comprises a second fitting on each of said tanks.

7. The apparatus of claim 4 wherein said bottom panel assembly comprising opening means for accessing said means for filling each of said tanks when said apparatus is fully assembled.

8. The apparatus of claim 1 wherein each of said tanks comprises a length of polyvinyl chloride (PVC) pipe.

9. The apparatus of claim 1 wherein said attachment means includes screws and wing nuts.

10. The apparatus of claim 1 wherein said front panel includes keyed locking means for locking and unlocking said apparatus as needed.

11. The apparatus of claim 10 wherein said keyed locking means comprises:

a handle having a key slot;

a substantially round cam fixedly coupled to said handle, said cam having eccentrically coupled thereto at least one locking bar that extends in response to said handle being turned in a locked position; and at least one locking bracket fixedly coupled to said top panel, with a hole corresponding to said locking bar, which locking bar passes through said hole when extended to thereby lock the top panel in its closed position.

12. A storage apparatus for small vehicles comprising, in combination:

a rear panel;

a right side panel coupled to said rear panel;

a left side panel coupled to said rear panel;

a front panel coupled to both said right side panel and said left side panel;

a top panel coupled to at least one of said rear panel, said right side panel, said left side panel, and said front panel;

a bottom panel assembly coupled to said rear panel, said right side panel, said left side panel and said front panel and comprising at least one upper platform and at least one lower platform separated by at least two side members to define at least one compartment within said bottom panel assembly;

each of said panels and said bottom panel assembly having attachment means for allowing assembly of said apparatus by hand without the use of tools; and ballast means for placement in said compartment of said bottom panel assembly to substantially increase the weight of said apparatus to prevent easily moving said apparatus, said ballast means comprises a plurality of completely enclosed liquid holding tanks extending along substantially the length of said bottom panel assembly, each of said tanks may be removed from said bottom panel assembly by removal of said rear panel from the apparatus and movement of each of said tanks rearward.

13. The apparatus of claim 1 wherein said top panel has at least one retaining arm movably coupled thereto to hold said top panel in an open position.

14. The apparatus of claim 1 wherein said rear panel, said right side panel, said left side panel, said front panel, said top panel, and said upper and lower platforms of said bottom panel assembly are each of substantially flat construction, allowing said panels and said upper and lower platforms to be stacked and stored in a relatively small space when said apparatus is disassembled and not in use.

* * * * *